US010099250B2

(12) United States Patent
Pajel et al.

(10) Patent No.: US 10,099,250 B2
(45) Date of Patent: Oct. 16, 2018

(54) LIGHT-CURABLE MATERIAL APPLICATOR AND ASSOCIATED METHODS

(71) Applicant: The Boeing Company, Chicago, IL (US)

(72) Inventors: Carissa A. Pajel, Redmond, WA (US); Benjamin P. Hargrave, Bellevue, WA (US); Darrin M. Hansen, Seattle, WA (US); Dion P. Coleman, Issaquah, WA (US); Michael D. Jones, Kent, WA (US)

(73) Assignee: The Boeing Company, Chicago, IL (US)

( * ) Notice: Subject to any disclaimer, the term of this patent is extended or adjusted under 35 U.S.C. 154(b) by 449 days.

(21) Appl. No.: 14/742,019

(22) Filed: Jun. 17, 2015

(65) Prior Publication Data

US 2016/0368005 A1 Dec. 22, 2016

(51) Int. Cl.

| | |
|---|---|
| ***B05B 12/12*** | (2006.01) |
| ***B05D 3/06*** | (2006.01) |
| ***B05B 7/22*** | (2006.01) |
| ***B05C 9/12*** | (2006.01) |
| ***B05C 17/005*** | (2006.01) |
| *B05B 1/28* | (2006.01) |

(52) U.S. Cl.

CPC ..... *B05D 3/067* (2013.01); *B05B 7/228* (2013.01); *B05C 9/12* (2013.01); *B05C 17/0052* (2013.01); *B05B 1/28* (2013.01); *B05B 12/124* (2013.01); *B05B 12/126* (2013.01)

(58) Field of Classification Search

CPC ..... B05B 7/22; B05B 7/228; B05B 12/124; B05B 12/126; B05C 17/005–17/015; B05C 9/12; B05D 3/108

See application file for complete search history.

(56) References Cited

U.S. PATENT DOCUMENTS

| | | | | |
|---|---|---|---|---|
| 2006/0108450 | A1* | 5/2006 | Klinkenberg | B05B 7/228 239/525 |
| 2007/0246666 | A1* | 10/2007 | Bich | B43K 8/14 250/559.38 |
| 2009/0092764 | A1* | 4/2009 | Hoeckelman | B05B 7/228 427/508 |
| 2009/0179081 | A1* | 7/2009 | Charpie | B05B 7/0815 239/11 |

* cited by examiner

*Primary Examiner* — Dah-Wei D. Yuan
*Assistant Examiner* — Stephen A Kitt
(74) *Attorney, Agent, or Firm* — Kunzler, PC

(57) ABSTRACT

Described herein is an apparatus for applying and curing a light-curable material on a work surface. The apparatus includes a nozzle from which the light-curable material is applied to the work surface to form a layer of light-curable material on the work surface. The layer of light-curable material has a leading edge and a trailing edge defined according to a direction of movement of the nozzle relative to the work surface. The apparatus also includes a light source fixed relative to the nozzle. The light source is operable to direct a light beam to the trailing edge of the layer of light-curable material.

15 Claims, 9 Drawing Sheets

LIGHT-CURABLE MATERIAL APPLICATOR AND ASSOCIATED METHODS

FIELD

This disclosure relates to the application of materials onto surfaces, and more particularly to applying and curing light-curable materials on surfaces.

BACKGROUND

Conventional methods of manufacturing components with light-curable materials include applying a light-curable material onto a surface and curing the light-curable material in two temporally separate processes, which can result in increased manufacturing cost and time. Also, some conventional methods are not conducive to applying and curing light-curable materials in confined-space environments or light-sensitive environments.

SUMMARY

The subject matter of the present application has been developed in response to the present state of the art, and in particular, in response to the problems and needs associated with conventional methods and apparatuses for manufacturing components with light-curable materials. In general, the subject matter of the present application has been developed to provide apparatuses and methods for applying and curing a light-curable material on a work surface that overcome at least some of the above-discussed shortcomings of the prior art. For example, in some embodiments, apparatuses and methods described herein provide for the application and curing of light-sensitive materials on components in a one-step process that is conducive to confined-space and light-sensitive environments.

According to some embodiments, an apparatus for applying and curing a light-curable material on a work surface includes a nozzle from which the light-curable material is applied to the work surface to form a layer of light-curable material on the work surface. The layer of light-curable material has a leading edge and a trailing edge defined according to a direction of movement of the nozzle relative to the work surface. The apparatus also includes a light source fixed relative to the nozzle. The light source is operable to direct a light beam to the trailing edge of the layer of light-curable material.

In certain implementations, the apparatus further includes a direction determination device operable to determine the direction of movement of the nozzle relative to the work surface. The apparatus also includes a control module operatively coupled to the light source. The control module controls operation of the light source in response to the direction of movement of the nozzle relative to the work surface determined by the direction determination device.

According to some implementations of the apparatus, the light source includes at least a first light and a second light. The control module activates the first light and deactivates the second light in response to the direction of movement of the nozzle relative to the work surface determined by the direction determination device being a first direction. The control module deactivates the first light and activates the second light in response to the direction of movement of the nozzle relative to the work surface determined by the direction determination device being a second direction different than the first direction. The first light can be adjacent a first side of the nozzle and the second light can be adjacent a second side of the nozzle. The first side is opposite the second side and the first direction is opposite the second direction.

In some implementations of the apparatus, the light source includes a first bank of lights with a plurality of lights and a second bank of lights with a plurality of lights. The control module activates the first bank of lights and deactivates the second bank of lights in response to the direction of movement of the nozzle relative to the work surface determined by the direction determination device being a first direction. The control module deactivates the first bank of lights and activates the second bank of lights in response to the direction of movement of the nozzle relative to the work surface determined by the direction determination device being a second direction different than the first direction.

According to certain implementations of the apparatus, the direction determination device includes an accelerometer fixed relative to the nozzle. The apparatus may further include a robotic arm. The nozzle and light source can be coupled to the robotic arm. Further, the direction determination device can include a controller of the robotic arm.

In certain implementations, the direction determination device is operable to determine a rate of movement of the nozzle relative to the work surface. The control module can adjust an intensity of the light beam in response to the rate of movement determined by the direction determination device.

According to some implementations, the apparatus further includes a flow regulation device that is operable to adjust a flow rate of the light-curable material from the nozzle. The direction determination device is operable to determine a rate of movement of the nozzle relative to the work surface. The control module can adjust a flow rate of the light-curable material from the nozzle in response to the rate of movement determined by the direction determination device.

In some implementations, the apparatus further includes a distance determination device that is operable to determine a distance between the nozzle and the work surface. The control module can adjust the light beam in response to the distance between the nozzle and the work surface determined by the distance determination device.

According to certain implementations, the apparatus also includes a distance determination device that is operable to determine a distance between the nozzle and the work surface. The apparatus also includes a flow regulation device that is operable to adjust at least one characteristic of the flow of the light-curable material from the nozzle. The control module can adjust the at least one characteristic of the flow of the light-curable material from the nozzle in response to the distance between the nozzle and the work surface determined by the distance determination device.

In some implementations, the apparatus further includes a lens coupled to the light source. The lens is operable to adjust a direction of the light beam from the light source. The light source may include a plurality of lights arranged in a circular pattern about the nozzle.

According to some implementations of the apparatus, the light-curable material flows through the nozzle in an application direction. The light source can be offset from the nozzle in the application direction.

In yet some implementations, the apparatus also includes a light housing that includes a recessed surface. The light source is mounted on the recessed surface.

According to another embodiment, a hand-held apparatus for applying and curing a light-curable material on a work surface includes a nozzle. The light-curable material is applied from the nozzle to the work surface to form a layer of light-curable material on the work surface. The hand-held apparatus also includes a light source fixed relative to the nozzle and a control module operatively coupled to the light source. Further, the light source includes an accelerometer fixed relative to the nozzle and operatively coupled to the control module. The control module operates the light source in response to input from the accelerometer.

In some implementations, the hand-held apparatus further includes a first trigger manually actuatable into a first active position to initialize a flow of light-curable material from the nozzle to the work surface. The hand-held apparatus may also include a second trigger manually actuatable into a second active position to initialize control of the light source.

According to certain implementations, the hand-held apparatus also includes a distance determination sensor fixed relative to the nozzle and operable to detect a distance between the nozzle and the work surface. The control module can be operable to adjust operation of the light source in response to a distance between the nozzle and the work surface detected by the distance determination sensor.

In yet some implementations, the hand-held apparatus further includes a flow regulation device operable to adjust a flow rate of the light-curable material from the nozzle. The control module can be operably coupled to the flow regulation device. Additionally, the control module may be operable to adjust the flow rate of the light-curable material from the nozzle in response to input from the accelerometer.

According to another embodiment, a method of applying and curing a light-curable material on a work surface includes applying a light-curable material to the work surface from a nozzle. The method also includes determining a direction of movement of the nozzle with respect to the work surface. Additionally, the method includes, while applying the light-curable material to the work surface, directing a light beam to the light-curable material applied to the work surface. Also, the method includes adjusting characteristics of the light beam in response to the direction of movement of the nozzle.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
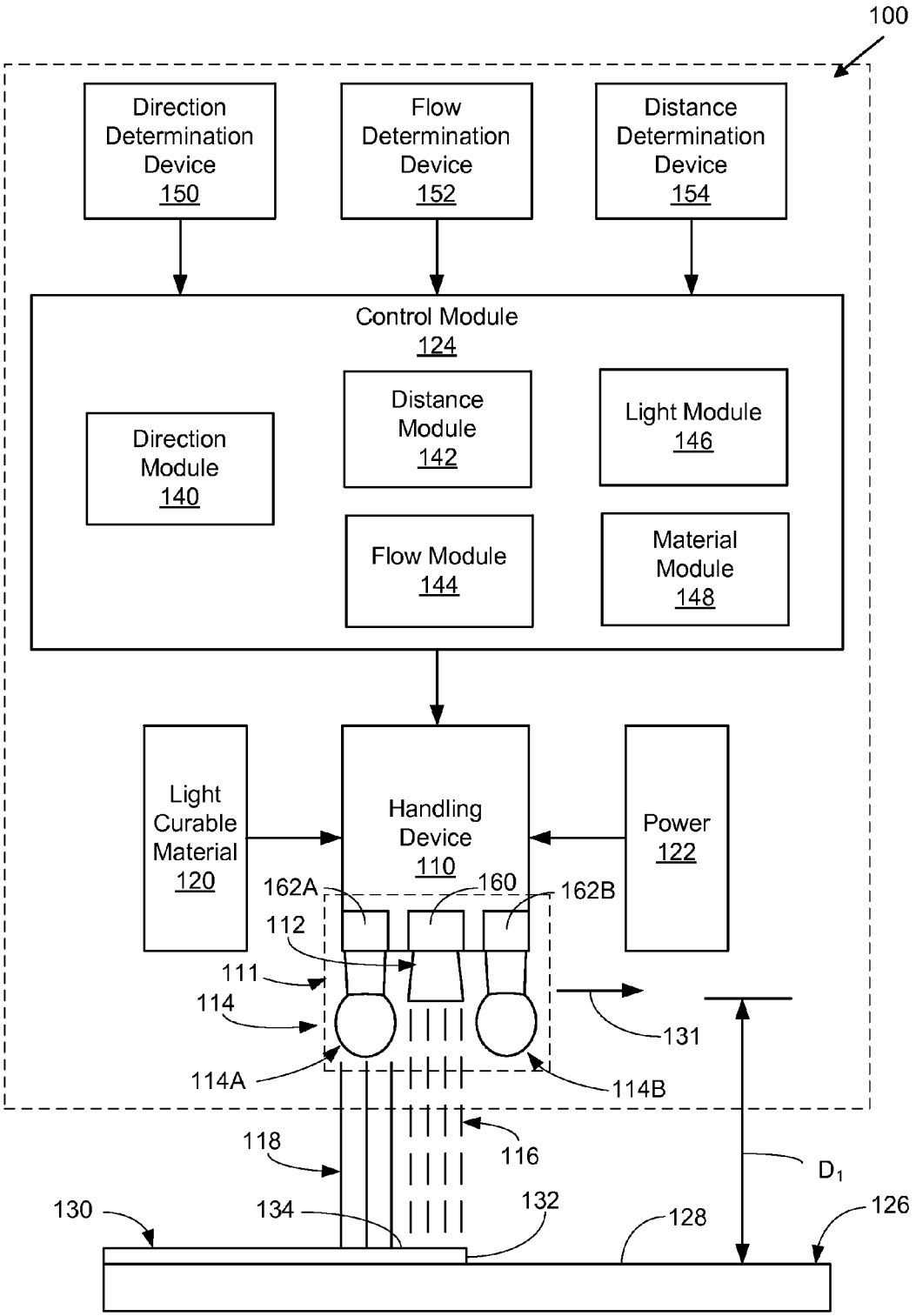
FIG. 1 is a schematic block diagram illustrating an apparatus for applying and curing a light-curable material on a work surface, according to one embodiment.

Referring to FIG. 1, and according to one embodiment, an apparatus 100 for applying and curing a light-curable material on a work surface includes a handling device 110. Generally, the handling device 110 receives a light-curable material 120 and applies the light-curable material in the form of a flow 116 of light-curable material 120 onto a work surface 128 of a workpiece 126. The flow 116 of light-curable material 120 is a spray or mist of light-curable material in some embodiments. The handling device 110 is moved relative to the work surface 128, such as in direction 131, while applying the light-curable material 120 onto the work surface to form a layer 130 of light-curable material of a given thickness on the work surface. The light-curable material 120 can be any of various materials that are curable via the application of light. Some light-curable materials include resin-based composites used as coatings and sealants. Light-curable materials may also include paints, inks, and other coatings.

The thickness of the layer 130 of light-curable material is at least partially dependent on the flow rate of the flow 116 of light-curable material 120 and the rate of movement of the handling device 110 relative to the work surface 128. For example, for a given flow rate of the flow 116, the thickness of the layer 130 of light-curable material increases as the rate of movement of the handling device 110 decreases and the thickness of the layer of light-curable material decreases as the rate of movement of the handling device 110 increases. Likewise, for a given rate of movement of the handling device 110, the thickness of the layer 130 of light-curable material increases as the flow rate of the flow 116 increases and the thickness of the layer of light-curable material decreases as the flow rate of the flow decreases. Of course, it is recognized that other characteristics of the flow 116 of light-curable material 120, such as the viscosity and density of the light-curable material, the spray pattern of the flow, the coverage area of the flow, and the distance $D_1$ the handling device 110 is away from the work surface 128, may affect the thickness of the layer 130 of light-curable material. But, assuming all other characteristics affecting the thickness of the layer 130 are constant and uniform, the thickness of the layer 130 can be controlled (e.g., adjusted) by controlling the flow rate of the flow 116 of light-curable material 120 relative to the rate of movement of the handling device 110 relative to the work surface 128.

The handling device 110 generates the flow 116 of light-curable material 120 for application onto the work surface 128 via a nozzle portion 112 of a head 111 of the handling device 110. The head 111 further includes a flow regulation device 160 that regulates the flow rate of the flow 116 of light-curable material 120. For example, the flow regulation device 160 includes a flow metering valve in some implementations. Additionally, in some implementations, the flow regulation device 160 may control the flow pattern of the flow 116. For example, the flow regulation device 160 may include a variable geometry nozzle that is adjustable to create a plurality of spray patterns. Further details concerning several embodiments of a head and nozzle portion is described in more detail below.

Concurrent with the handling device 110 applying the layer 130 of light-curable material 120 onto the work surface 128 of the workpiece 126, the handling device generates and directs a light beam 118 to the light-curable material applied to the work surface. More specifically, the handling device 110 directs the light beam 118 to the layer 130 of light-curable material 120 applied to the work surface 128. In other words, the handling device 110 directs the light beam 118 towards the layer 130 of light-curable material 120 such that the light beam impacts the layer of light-curable material after it has been applied to the work surface 128. As the light beam 118 impacts the layer 130 of light-curable material 120, the light-curable material begins to cure or set on the work surface 128. The intensity of the light beam 118 and the duration of impact of the light beam on the layer 130 are selected to cure the light-curable material 120 to a desired cure level. The intensity of the light beam 118 is dependent on an intensity of a light source generating the light beam. The duration of impact of the light beam 118 on the layer 130 is dependent on the rate of movement of the handling device 110 relative to the work surface 128. Because the cure level of the light-curable material is dependent on both the intensity of the light beam 118 and the duration of impact of the light beam on the layer 130, a desired cure level can be achieved by controlling the intensity of the light source generating the light beam and the rate of movement of the handling device 110.

In some embodiments, the direction and pattern of the light beam 118 is controlled so as to not impact the flow 116 of light-curable material 120 before it is applied onto the work surface 128 as the layer 130. Impacting the flow 116 of light-curable material 120 before it is applied onto the work surface 128 causes premature curing of the light-curable material before it is laid down on the work surface 128. Premature curing of the light-curable material can negatively affect the ability of the light-curable material to properly form the layer 130 and adhere to the workpiece 126. Additionally, premature curing of the light-curable material may result in damage to the workpiece 126. In some implementations, the workpiece 126 may be made from a precured composite material, such as fiber-reinforced polymers, which may experience degradation if exposed directly to the light beam 118, particularly if the duration and frequency of the light beam is within a range that is harmful to the workpiece. The workpiece 126 may form part of a larger structure, such as an aircraft or other vehicle.

Generally, the direction of the light beam 118 is controlled by controlling the location of the source of the light beam, and the pattern of the light beam is controlled by controlling the beam divergence of the light beam. Controlling the location of the source of the light beam 118 can be controlled by selectively activating and deactivating one or more of a plurality of light sources. The beam divergence of the light beam can be controlled by auxiliary devices, such as adjustable lenses, flaps, and guides, and by selecting light with low divergence (e.g., coherent light).

As shown in FIG. 1, the direction of the light beam 118 is controlled to impact only a trailing edge 134 of the layer 130 of light-curable material 120. As defined herein, at any given moment in time, the layer 130 of light-curable material 120 has a leading edge 132 and a trailing edge 134. As shown, the leading edge 132 is spaced apart from the trailing edge 134 by the flow 116 of light-curable material 120. Generally, the leading edge 132 and trailing edge 134 are defined according to the direction 131 of movement of the handling device 110. The leading edge 132 is a downstream edge of the layer 130 when moving in the direction 131 and the trailing edge 134 is an upstream edge of the layer when moving in the direction 131. The trailing edge 134 or upstream edge is upstream of the flow 116 of light-curable material in the direction 131. In the direction 131, the leading edge 134 can be defined as an end of the layer 130, while the trailing edge 134 can be defined as a beginning or intermediate portion between the end and the beginning of the layer. In some implementations, the trailing edge 134 is defined as any portion of the layer 130 of light-curable material 120 downstream of the flow 116 of light-curable material relative to the direction 131.

The handling device 110 generates and directs the light beam 118 for curing light-sensitive material 120 applied onto the work surface 128 via a light source portion 114 of the head 111 of the handling device 110. The light source portion 114 includes at least one first light source 114A and at least one second light source 114B. The head 111 further includes first and second light control devices 162A, 162B that control one or more characteristics of light beams 118 generated by the first and second light sources 114A, 114B, respectively. Exemplary characteristics of the light beams controlled by the light control devices may include activation and deactivation of the light beams, and an intensity of the light beams. For example, each of the first and second light control devices 162A, 162B may include electronic switches, circuits, and/or logic to control operation of the light sources 114A, 114B. The light source portion 114 is fixed relative to the nozzle portion 112, which is fixed relative to the handling device 110. Additional details concerning several embodiments of a light source portion is described in more detail below.

The apparatus 100 also includes power 122 from a power source. The power 122 can include electric power for powering electrical components of the handling device 110. Additionally, the power 122 can be non-electric power, such as pneumatic power and hydraulic power, for powering non-electrical components of the handling device 110.

As further shown in FIG. 1, the apparatus 100 includes a control module 124 operatively coupled to the handling device 110 to control various operations of the handling device. The control module 124 includes at least one of a direction module 140, distance module 142, flow module 144, light module 146, and material module 148. The control module 124 in FIG. 1 is depicted as a single physical unit, but can include two or more physically separated units or components in some embodiments if desired. Generally, the control module 124 receives multiple inputs, processes the inputs, and transmits multiple outputs. The multiple inputs may include data from physical or virtual sensors and various user inputs. The inputs are processed by the control module 124 using various algorithms, stored data, and other inputs to update the stored data and/or generate output values. The generated output values and/or commands are transmitted to other components of the control module 124 and/or to one or more elements of the handling device 110 to control the handling device for achieving desired results.

The direction module 140 determines a direction of movement of the handling device 110. According to one embodiment, the direction module 140 determines the direction of movement of the handling device 110 by interpreting and processing input from a direction determination device 150 of the apparatus 100. The direction determination device 150 is configured to detect or sense the direction of movement of the handling device. Accordingly, the direction determination device 150 also is configured to determine the direction of movement of the handling device 110. In some implementations, the direction determination device 150 is an accelerometer, or other similar sensor.

According to another embodiment, the direction module 140 determines the direction of movement of the handling device 110 based on a preset pattern of movement of the handling device without input from a direction determination device 150 as described above, or where the direction determination device is an automatic or autonomous control system. An automatic control system operates based on user input, while an autonomous control system operates without user input. For example, the handling device 110 may be automatically or autonomously controlled to move relative to the work surface 128 of the workpiece 126 according to the preset pattern. Accordingly, electronic signals that autonomously control the movement of the handling device 110 may be directly or indirectly communicated to the direction module 140, which determines the direction of movement of the handling device based on the signals.

Additionally, the direction module 140 may determine a rate of movement (e.g., velocity) of the handling device 110. According to one embodiment, the direction module 140 determines the rate of movement of the handling device 110 by interpreting and processing input from the direction determination device 150 of the apparatus 100. The direction determination device 150 can be configured to detect or sense the rate of movement of the handling device. Accordingly, the direction determination device 150 is configured to determine the rate of movement of the handling device 110. In another embodiment, the rate of movement of the handling device 110 is determined based on electronic signals that autonomously control the movement of the handling device 110 according to a preset pattern at a preset rate of movement.

The distance module 142 determines the distance $D_1$ between the work surface 128 and a nozzle of the nozzle portion 112 of the head 111. According to one embodiment, the distance module 142 determines the distance $D_1$ by interpreting and processing input from a distance determination device 154 or range finder of the apparatus 100. The distance determination device 154 is configured to detect or sense the distance $D_1$. Accordingly, the distance determination device 154 also is configured to determine the distance $D_1$. In some implementations, the distance determination device 154 is a proximity sensor, such as an infrared proximity sensor, laser proximity sensor, or mechanical proximity sensor.

According to another embodiment, the distance module 142 determines the distance $D_1$ between the work surface 128 and a nozzle of the nozzle portion 112 based on a preset position of the handling device relative to the work surface 128 without input from a distance determination device 154 as described above, or where the distance determination device is an autonomous control system. For example, the handling device 110 may be autonomously controlled to move into preset positions away from the work surface 128 of the workpiece 126 according to a preset pattern. Accordingly, electronic signals that autonomously control the movement of the handling device 110 may be directly or indirectly communicated to the direction module 140, which determines the distance $D_1$ based on the signals.

The flow module 144 determines a flow rate of the flow 116 of light-curable material 120. According to one embodiment, the flow module 144 determines the flow rate of the flow 116 by interpreting and processing input from a flow determination device 152 of the apparatus 100. The flow determination device 152 is configured to detect or sense the flow rate of the flow 116. Accordingly, the flow determination device 152 directly or indirectly determines the flow rate of the flow 116. In some implementations, the flow determination device 152 is a flow sensor or liquid flow meter in fluid receiving communication with the flow 116.

According to another embodiment, the flow module 144 determines the flow rate of the flow 116 based on a preset flow rate without input from a flow determination device 152 as described above, or where the flow determination device is an autonomous control system. For example, the handling device 110 may be autonomously controlled to apply the flow 116 of light-curable material 120 at a preset flow rate. Accordingly, electronic signals that autonomously control the flow rate of the flow 116 may be directly or indirectly communicated to the flow module 144, which determines the flow rate of the flow based on the signals.

The light module 146 controls operation of the light sources 114A, 114B of the light source portion 114 of the head 111. The light module 146 controls the activation and deactivation of the light sources 114A, 114B, as well as controls the intensity of the light beams generated by the light sources. For example, as shown in FIG. 1, the light source 114A is activated to generate the light beam 118 for impacting the trailing edge 134 of the layer 130 of light-curable material 120, and the light source 114B is deactivated such that a light beam does not impact the leading edge 132 of the layer. Generally, as will be described in more detail below, the light module 146 controls operation of the light sources 114A, 114B based on at least one of the direction of movement of the handling device 110, the rate of movement of the handling device, the distance $D_1$, and the flow rate of the flow 116. In some embodiments, the light module 146 receives the direction of movement of the handling device 110, the rate of movement of the handling device, the distance $D_1$, and the flow rate of the flow 116 from the direction module 140, distance module 142, and flow module 144, respectively. Alternatively, the light module 146 receives the direction of movement of the handling device 110, the rate of movement of the handling device, the distance $D_1$, and the flow rate of the flow 116 from the direction determination device 150, flow determination device 152, and distance determination device 154, respectively.

The material module 148 controls operation of the nozzle portion 112 of the head 111. The material module 148 controls the flow rate of the flow 116 of light-curable material 120, as well as controls the pattern of the flow in some implementations. Generally, as will be described in more detail below, the material module 148 controls at least one of the flow rate and flow pattern of the flow 116 based on at least one of the direction of movement of the handling device 110, the rate of movement of the handling device, the distance $D_1$, and the flow rate of the flow 116. In some embodiments, the material module 148 receives the direction of movement of the handling device 110, the rate of movement of the handling device, the distance $D_1$, and the flow rate of the flow 116 from the direction module 140, distance module 142, and flow module 144, respectively. Alternatively, the material module 148 receives the direction of movement of the handling device 110, the rate of movement of the handling device, the distance $D_1$, and the flow rate of the flow 116 from the direction determination device 150, flow determination device 152, and distance determination device 154, respectively.

The handling device 110 is automatically or autonomously operated in some embodiments. For example, the handling device 110 can be an end effector coupled to a robotic arm. The robotic arm can be controlled to move the handling device 110 relative to the work surface 128. Further, operation of the handling device 110, including generating the flow 116 of light-curable material 120 and generating the light beam 118, can be performed automatically or autonomously. In certain implementations, movement and operation of the handling device 110 are based on predetermined or sensed information, such as size, shape, position, and orientation of the workpiece 126, a preset application pattern, and preset characteristics of the layer 130. The control module 124 can be remote from, not form part of, or be non-fixed relative to the handling device 110 when automatically or autonomously operated. Similarly, the direction determination device 150, flow determination device 152, and distance determination device 154 can be remote from, not form part of, or be non-fixed relative to the handling device 110 when automatically or autonomously operated.

The handling device 110 is hand-held or manually operated in some embodiments. For example, the handling device 110 can form part of a manually operable tool, such as a spray gun. Operation of the handling device 110, including generating the flow 116 of light-curable material 120 and generating the light beam 118, can be performed manually via physical actuation of the handling device. In certain implementations, movement and operation of the handling device 110 are based on physical manipulation of the handling device 110 by a user. Although the control module 124, direction determination device 150, flow determination device 152, and distance determination device 154 can be remote from or not form part of a hand-held handling device 110, in preferred embodiments, at least one of the control module 124, direction determination device 150, flow determination device 152, and distance determination device 154 can be onboard, form part of, or be fixed relative to the handling device 110 as indicated by dashed lines in FIG. 1.

Figure 2:
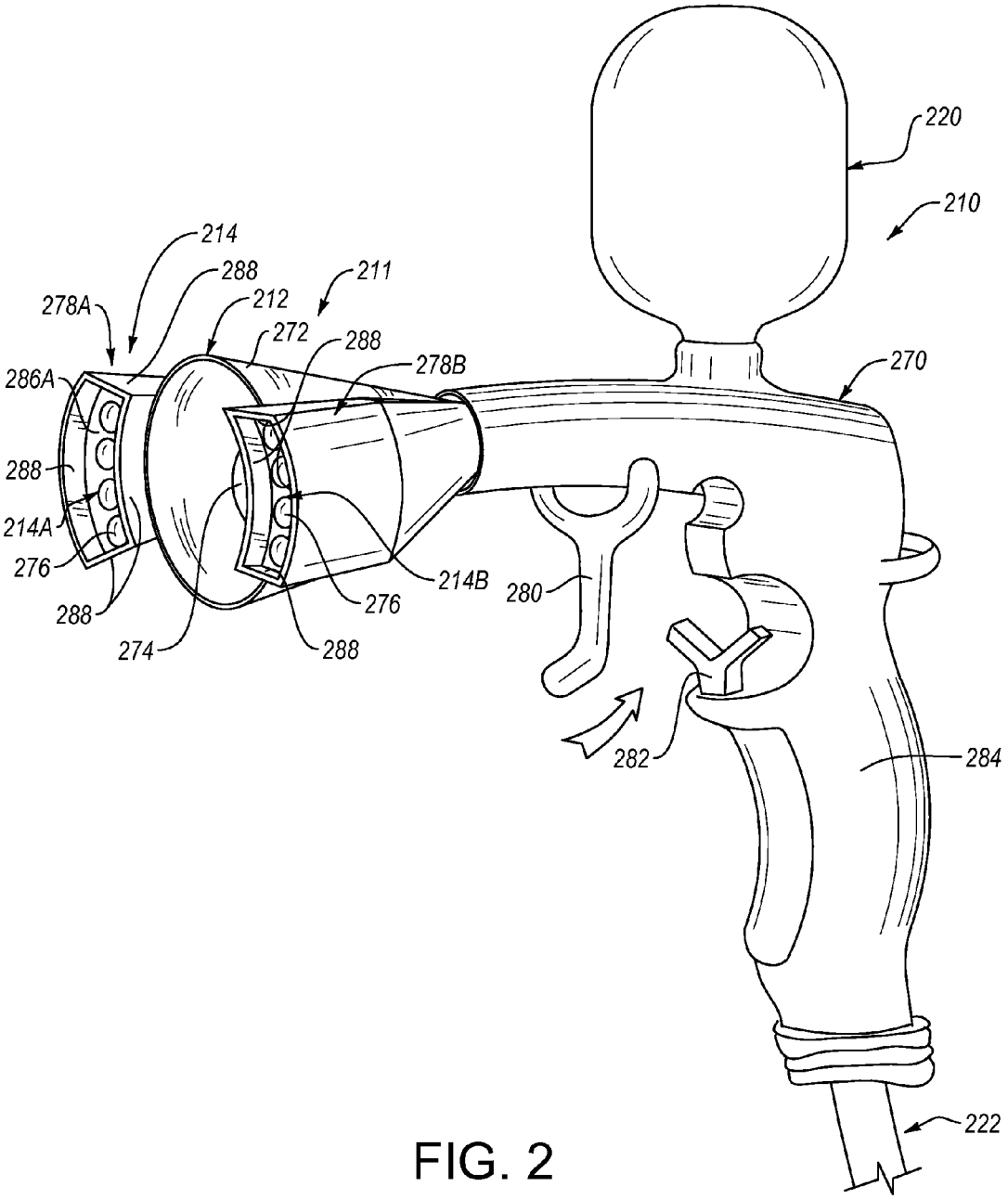
FIG. 2 is a perspective view illustrating a hand-held apparatus for applying and curing a light-curable material on a work surface, according to one embodiment.

Referring to FIG. 2, one embodiment of a hand-held handling device 210 is shown. The hand-held handling device 210 is in the form of a hand-held tool or spray gun. Further, the hand-held handling device 210 includes some features analogous to the features of the handling device 110, with like numbers referring to like elements. The handling device 210 includes a frame 270 to which a head 211 is attached. The frame 270 includes a handle 284 for gripping by a user. Generally, the frame 270 is a rigid member made from a rigid material, such as a hardened plastic or metal. The frame 270 also includes an interface for interfacing with a supply of light-curable material 220, which in the illustrated embodiment, is in the form of a storage container containing the light-curable material. Additionally, the frame 270 includes an interface for interfacing with power 222, which can be in the form of electrical power and/or non-electrical power. Although not shown, at least one of a control module, direction determination device, flow determination device, and distance determination device can be mounted onboard, form part of, or be fixed relative to the hand-held handling device 210.

The head 211 includes a nozzle portion 212 and a light source portion 214. The nozzle portion 212 is fixed relative to the light source portion 214. The nozzle portion 212 includes a nozzle 274 and a shield 272 encircling the nozzle. The nozzle 274 includes at least one port 292 through which the light-curable material 220 flows prior to being expelled from the nozzle generally in the direction 290, which can be defined as an application direction. Although not shown, fluid conduits fluidly coupling the light-curable material 220 stored in the storage container and the nozzle 274 may be housed within the frame 270. In some implementations, the nozzle 274 includes two ports 292 (and two fluid conduits) through which first and second compositional parts of the light-curable material 220 flow before being combined to form the light-curable material upon being expelled from the nozzle. Although not shown, the at least one port 292 of the nozzle 274 may include a neck portion, or diverging and converging portions, that facilitates the acceleration of the light-curable material 220 before expelling the material from the nozzle. The nozzle can be defined as any of various structures or spouts capable of controlling the flow of material.

The spray pattern of the light-curable material 220 expelled from the nozzle 274 is determined by at least one of the shield 272 and a flow regulation device, such as flow regulation device 160, fluidly coupled to the nozzle. The shield 272 constrains the flow of light-curable material 220 to provide a desirable spray pattern. For example, the shield 272 has a conical shape that diverges from the nozzle 274 in the direction 290 to allow the flow to expand or diverge into the desired spray pattern. The substantially circular cross-sectional shape of the shield 272 results in a spray pattern with a substantially circular application area. Additionally, or alternatively, the flow regulation device may adjust a geometry of the nozzle 274 to adjust the spray pattern of the flow of light-curable material 220 from the nozzle.

The flow rate of the flow from the nozzle 274 may be adjustable by the same or a different flow regulation device fluidly coupled to the nozzle. The flow regulation device of the handling device 210 can be similar to the flow regulation device 160 to adjust the flow rate of the flow from the nozzle 274 as commanded by a control module, such as control module 124, which can be fixedly attached to the handling device.

Figure 3:
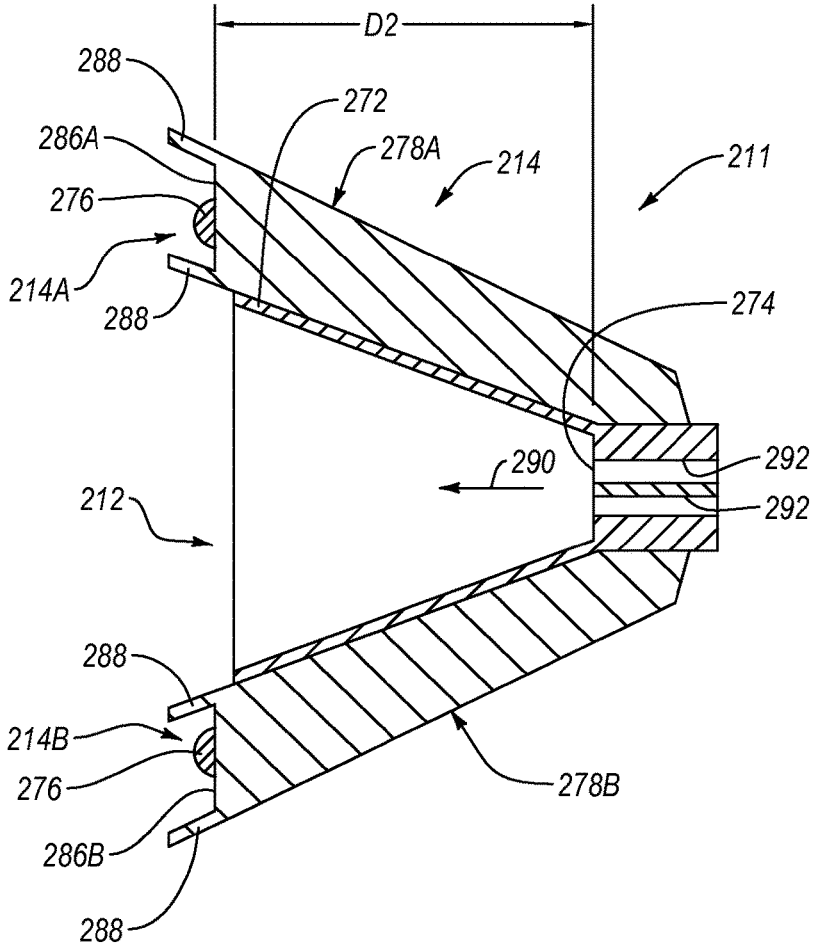
FIG. 3 is a cross-sectional top view of a head of the hand-held apparatus of FIG. 2.

The light source portion 214 includes a plurality of light sources 276 positioned circumferentially about the nozzle 274 in a generally circular pattern. In other words, the light sources 276 are positioned radially outwardly from the nozzle 274 or spaced apart from the nozzle in a radially outward direction. As illustrated, the light sources 276 may be positioned circumferentially about the shield 272 of the nozzle portion 212. The positioning of the light sources 276 about the nozzle 274 is facilitated by one or more light housings 278A, 278B. Additionally, referring to FIG. 3, in certain embodiments, the light sources 276 are positioned to be axially offset by a distance $D_2$ from the nozzle 274 in the axial or application direction indicated by direction 290. Axially offsetting the light sources 276 helps to reduce procuring of the flow of light-curable material 220 before the material is applied to the work surface 128.

Although not shown, each light housing 278A, 278B houses at least one light source 276 and contains electrical lines and circuitry for supply power to and controlling operation of the at least one light source housed by the light housing. Each light housing 278A, 278B can be attached to the frame 270 of the handling device 210 and/or the shield 272 of the nozzle portion 212. Each light housing 278A, 278B extends from a proximal end adjacent the nozzle 274 to a distal end axially spaced apart from the nozzle 274 in the direction 290. The distal end of each light housing 278A, 278B includes a plurality of sidewalls 288 surrounding a recessed surface 286A, 286B, respectively. In other words, each light housing 278A, 278B includes a plurality of sidewalls 288 that extends substantially transversely from a respective recessed surface 286A, 286B in the direction 290. In this manner, each recessed surface 286A, 286B is recessed in the distal end of the light housings 278A, 278B. The light sources 276 of each light housing 278A, 278B are mounted onto the respective recessed surface 286A, 286B of the light housings such that the light sources 276 are recessed in the distal ends of the light housings. Recessing the light sources 276 through use of the sidewalls 288 helps reduce impingement of the flow of the light-curable material 220 onto the light sources 276, and helps prevent curing of the light-curable material 200 on the nozzle 274.

In some embodiments, each light housing 278A, 278B houses a plurality of light sources 276. A plurality of light sources operatively grouped or controlled together can be defined as a bank of light sources. In other words, the light sources of a bank of light sources are activated, deactivated, and adjusted concurrently as a group. Each light housing 278A, 278B can be considered to house at least one bank of light sources 276, respectively. According to some implementations, each light housing 278A, 278B houses a single respective bank 214A, 214B of light sources 276.

Each light source 276 can be any of various light output devices, such as light bulbs, light emitting diodes, lasers, and the like. The light output devices can generate any of various types of light, such as coherent, partially coherent, and non-coherent. According to one embodiment, the light output devices of the light sources 276 generate ultraviolet light. In some implementations, each light output device is a light emitting diode that generates a beam of ultraviolet light.

The hand-held handling device 210 also includes a flow trigger 280 movably coupled to the frame 270. The flow trigger 280 is operatively coupled to the flow regulation device of the nozzle portion 212 to control the flow of light-curable material 220 through the nozzle 274 and onto the work surface 128. The flow trigger 280 can be mechanically, electrically, or electro-mechanically coupled to the flow regulation device. In operation, as the flow trigger 280 is actuated (e.g., pulled) into an active position by a user, such as via one or more fingers of the user while the user grips the handle 284, the coupling between the flow trigger and the flow regulation device actuates the flow regulation device to initialize the flow of light-curable material from the nozzle 274. Actuation of the flow regulation device may include opening a flow metering valve.

According to one embodiment, the hand-held handling device 210 includes a light trigger 282. The light trigger 282 is operatively coupled to the light control devices of the light source portion 214 to control (e.g., activate/deactivate) the light sources 276. The light trigger 282 can be mechanically, electrically, or electro-mechanically coupled to the light control devices. In operation, as the light trigger 282 is actuated (e.g., pulled) into an active position by a user as indicated by a direction arrow, such as via one or more fingers of the user while the user grips the handle 284, the coupling between the light trigger and the light control devices activates the light control devices to activate the light sources 276. Actuation of the light control devices may include closing an electrical circuit.

In some implementations, the operations of the flow trigger 280 and light trigger 282 are integrated into a single trigger. For example, actuation of the flow trigger 280 may concurrently initialize the flow of light-curable material 220 and activate of the light sources 276 without a separate light trigger 282. However, to facilitate separate initialization of the flow of light-curable material 220 and activation of the light sources 276, the flow trigger 280 can be positioned relative to the light trigger 282 as shown such that actuation of the flow trigger into its active position also actuates the light trigger into its active position by contacting and moving the light trigger. In this manner, concurrent initialization of the flow of light-curable material 220 and activation of the light sources 276 can be accomplished if desired. Additionally, if stand-alone activation of the light sources 276 without initialization of the flow of light-curable material is desired, the user may pull only the light trigger 282 without pulling the flow trigger 280. Stand-alone activation of the light sources 276 may be desirable provide a delayed initial curing of a layer of light-curable material 220 or additional curing to a layer of light-curable material that has been previously cured by the concurrent application and curing of the layer by the handling device 210.

Figure 4:
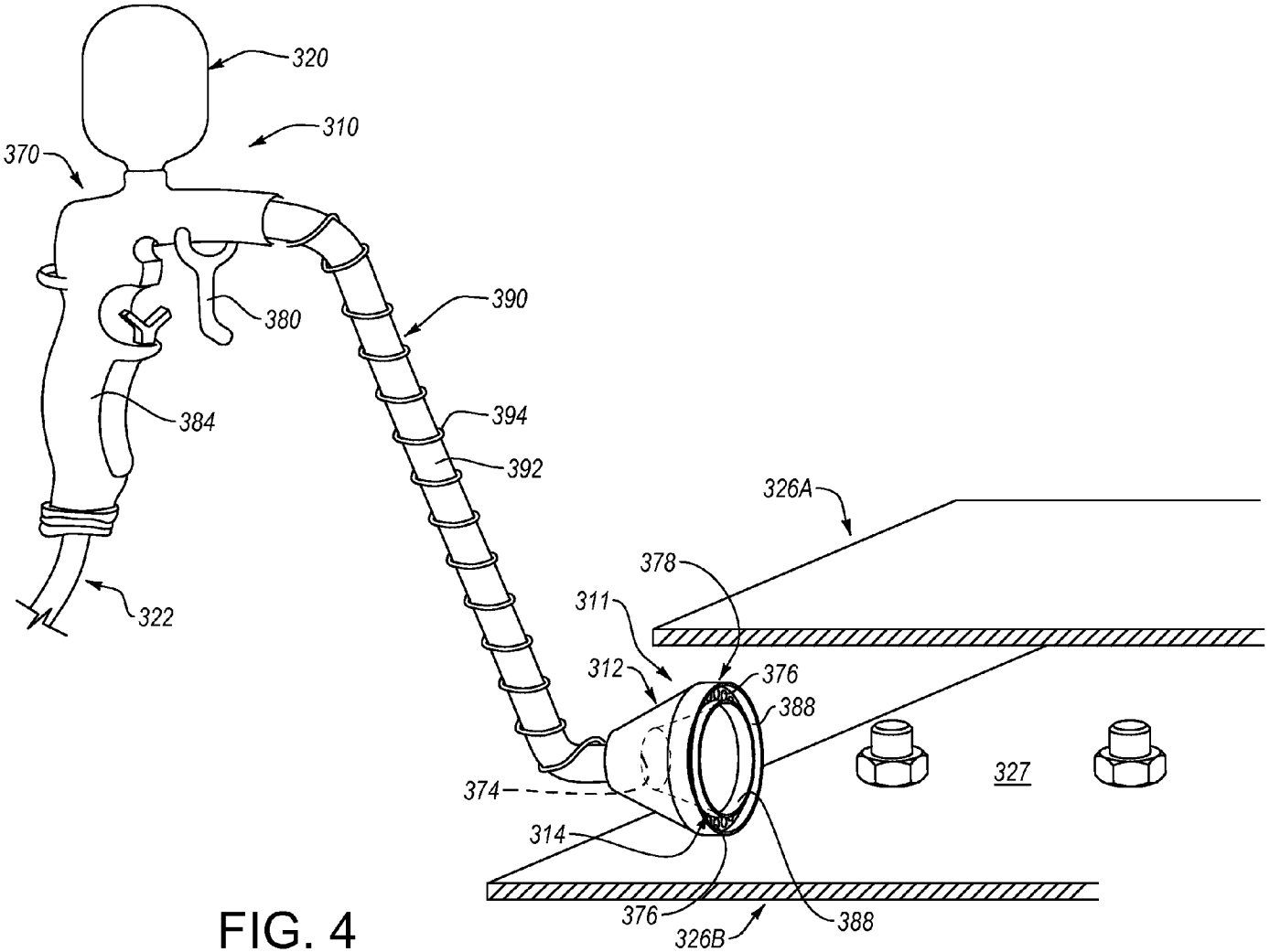
FIG. 4 is a perspective view illustrating a hand-held apparatus for applying and curing a light-curable material on a work surface, according to another embodiment.

Referring to FIG. 4, another embodiment of a hand-held handling device 310 is shown. The hand-held handling device 310 includes some features analogous to the features of the hand-held handling device 210, with like numbers referring to like elements. For example, the hand-held handling device 310 includes a frame 370, handle 384, light-curable material 320, power source 322, head 311, and trigger 380. The head 311 includes a nozzle portion 312 and a light source portion 314. The nozzle portion 312 includes a nozzle 374. The light source portion 314 includes a single light housing 378 with a plurality of light sources 376. In the illustrated embodiment, the light housing 378 is annular shaped with sidewalls 388 that define an annular-shaped recess within which the plurality of light sources 376 are mounted. Moreover, the plurality of light sources 376 are arranged in a circle about the nozzle 374 in a manner similar to the head 711 in FIG. 11. In contrast to the hand-held handling device 210, the hand-held handling device 310 includes a neck 390 extending between the frame 370 and the head 311. The neck 390 is elongate to position the head 311 a distance away from the frame 370. Further, in some embodiments, the neck 390 is flexible to position the head 311 in any of various positions relative to the frame 370, or the neck can be non-flexible in certain embodiments. The neck 390 includes a hollow tube 392 that facilitates the flow of light-curable material 320 from the frame 370 to the head 311. Additionally, the neck 390 includes a power line 394 that provides for the transmission of electrical and/or non-electrical power from the frame 370 to the head 311.

The elongate neck 390 of the hand-held handling device 310 is particularly useful for reaching work surfaces that are difficult to access. For example, for applying and curing a light-curable material to work surfaces defining an interior space 327 between two workpieces 326A, 326B, the elongate neck 390 allows the head 311 to be positioned within the space 327 if the frame 370 does not fit.

Referring to FIGS. 6-12, handling devices are shown being moved along a work surface in directions indicated by arrows in an application pattern with beginning and ending points. For each depiction of an application pattern (e.g., in FIGS. 6, 8, 10, and 12), the same handling device is shown multiple times at multiple locations along the application pattern. The application pattern can be a preset pattern and the handling device can be moved automatically or autonomously by a control system according to the preset pattern. Alternatively, the application pattern can be a non-set pattern established by the manual movement of the handling device by a user. As the handling device moves along an application pattern, a control module remote from or onboard the handling device controls activation and deactivation of light sources on the handling device in response to the direction of movement of the handling device. As discussed above, the direction of the movement of the handling device can be sensed, such as via an accelerometer, or predetermined.

Generally, in operation, at least one light source (e.g., a bank of light sources) on only a trailing edge of a head of the handling device is activated to generate a light beam that impacts only a trailing edge of a layer of light-curable material applied on the work surface, while any light sources (e.g., at least one bank of light sources) on non-trailing edges (e.g., leading edge or lateral edges) are deactivated or not activated such that a leading edge of the layer of light-curable material is not impacted with a light beam. Generally, although not necessarily, all light sources of a bank are activated concurrently when the bank is on the trailing edge of the head. Any light sources that are activated or banks of light sources with concurrently activated light sources are depicted in FIGS. 6, 8, 10, and 12 as a solid fill object, while deactivated light sources or banks with concurrently deactivated light sources are depicted in FIGS. 6, 8, 10, and 12 as an object without fill. It is recognized that the application patterns of FIGS. 6, 8, 10, and 12 are merely exemplary of application patterns that can be used with the corresponding handling devices. Moreover, depending on the configuration of the handling device and the desired application pattern, operation of a handling device may require rotation of the handling device such that the direction of movement of the handling device intersects at least one trailing light source or bank of light sources.

Figure 6:
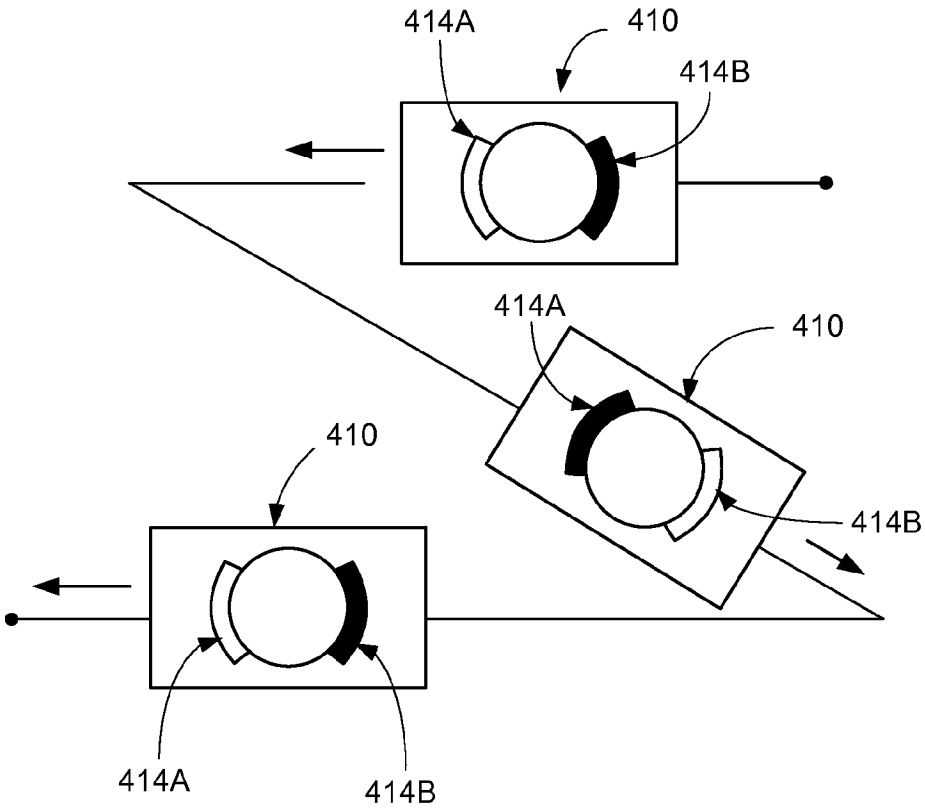
FIG. 6 is a schematic front view illustrating operation of the head of FIG. 5 along a first application path, according to one embodiment.
Figure 5:
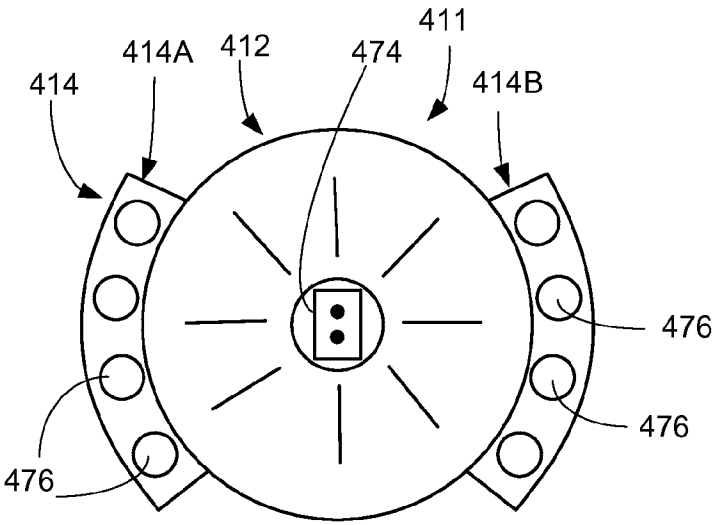
FIG. 5 is a schematic front view illustrating a head of an apparatus for applying and curing a light-curable material on a work surface, according to one embodiment.

Referring to FIGS. 5 and 6, the operation of a handling device 410 according to one embodiment is shown. The handling device 410 includes a head 411 with a nozzle portion 412 and a light portion 414. The light portion 414 has two banks 414A, 414B of light sources 476 on opposing sides of the head. The banks 414A, 414B of light sources 476 are positioned about and radially outwardly spaced apart from a nozzle 474.

In the illustrated embodiment of FIGS. 5 and 6, each bank 414A, 414B of light sources 476 is positioned on one of a leading and trailing edge of the head 411 depending on the direction of movement of the handling device 410. For example, when the handling device 410 is moving along the application pattern in the direction extending right-to-left across the page, the bank 414A of light sources is a leading bank and thus is not activated, and the bank 414B of light sources is a trailing bank and thus is activated. However, when the direction of movement of the handling device 410 changes to move along the application pattern in the diagonal direction extending left-to-right across the page, the bank 414A of light sources becomes a trailing bank and is activated, while the bank 414B of light sources becomes a leading bank and is deactivated. Finally, when the direction of movement of the handling device 410 changes back to the direction extending right-to-left across the page, the bank 414A of light sources again becomes a leading bank and is deactivated, while the bank 414B of light sources again becomes a trailing bank and is activated.

Figure 8:
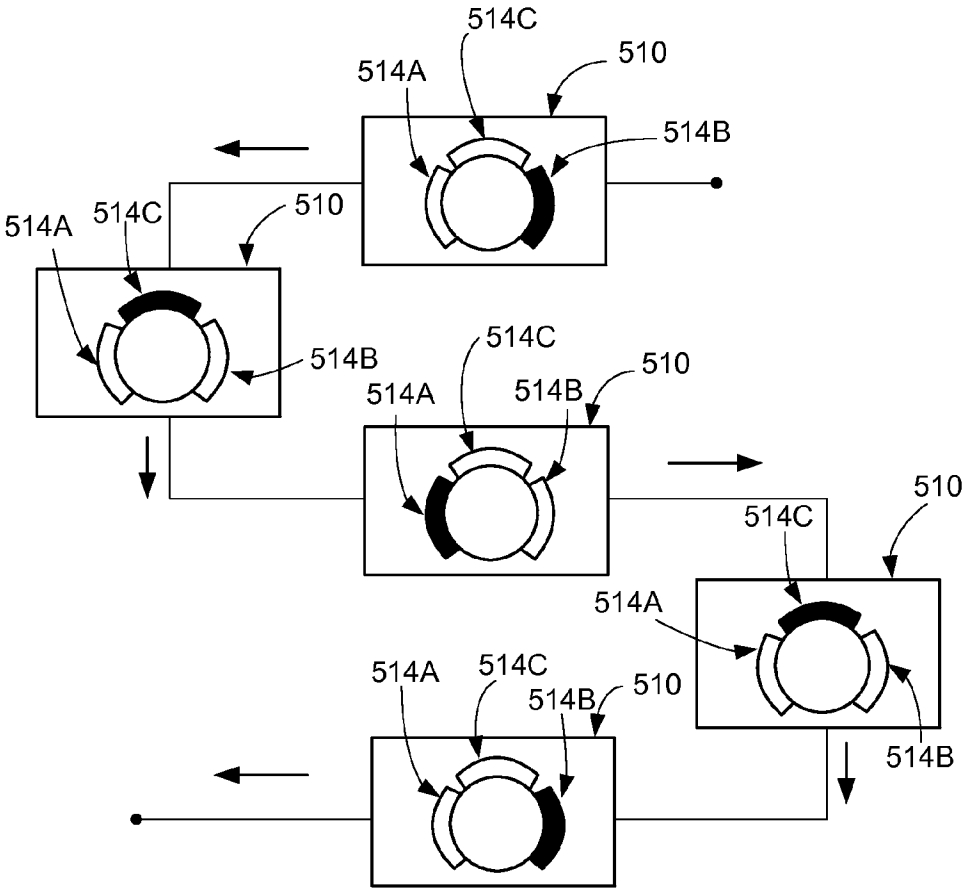
FIG. 8 is a schematic front view illustrating operation of the head of FIG. 7 along a second application path, according to one embodiment.
Figure 7:
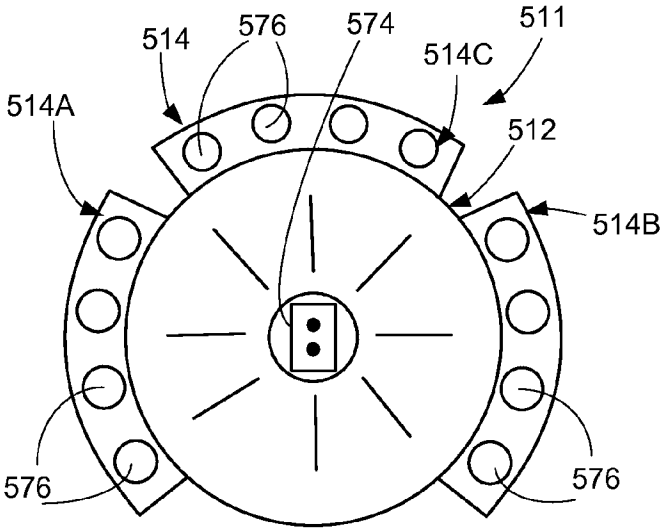
FIG. 7 is a schematic front view illustrating a head of an apparatus for applying and curing a light-curable material on a work surface, according to another embodiment.

Referring to FIGS. 7 and 8, the operation of a handling device 510 according to one embodiment is shown. The handling device 510 includes a head 511 with a nozzle portion 512 and a light portion 514. The light portion 514 has three banks 514A, 514B, 514C of light sources 576 on respective three sides of the head. The banks 514A, 514B, 514C of light sources 576 are positioned about and radially outwardly spaced apart from a nozzle 574.

Each bank 514A, 514B, 514C of light sources 576 is positioned on one of a leading edge, trailing edge, and lateral edge of the head 511 depending on the direction of movement of the handling device 510. For example, when the handling device 510 is moving along the application pattern in the direction extending right-to-left across the page, the bank 514A of light sources is a leading bank and thus is not activated, the bank 514C of light sources is a lateral bank and thus is not activated, and the bank 514B of light sources is a trailing bank and thus is activated. However, when the direction of movement of the handling device 510 changes to move along the application pattern in the direction extending top-to-bottom across the page, the bank 514A of light sources becomes a lateral bank and remains deactivated, while the bank 514B of light sources becomes a lateral bank and is deactivated and the bank 514C of light sources becomes a trailing bank and is activated. Then, when the direction of movement of the handling device 510 changes to a direction extending left-to-right across the page, the bank 514A of light sources becomes a trailing bank and is activated, while the bank 514B of light sources becomes a leading bank and remains deactivated and the bank 514C becomes a lateral bank and is deactivated. Finally, when the direction of movement of the handling device 510 changes back to the direction extending right-to-left across the page, the bank 514A of light sources again becomes a leading bank and remains deactivated, while the bank 514B of light sources again becomes a trailing bank and is activated and the bank 514C of light sources again becomes a lateral bank and is deactivated.

Figure 10:
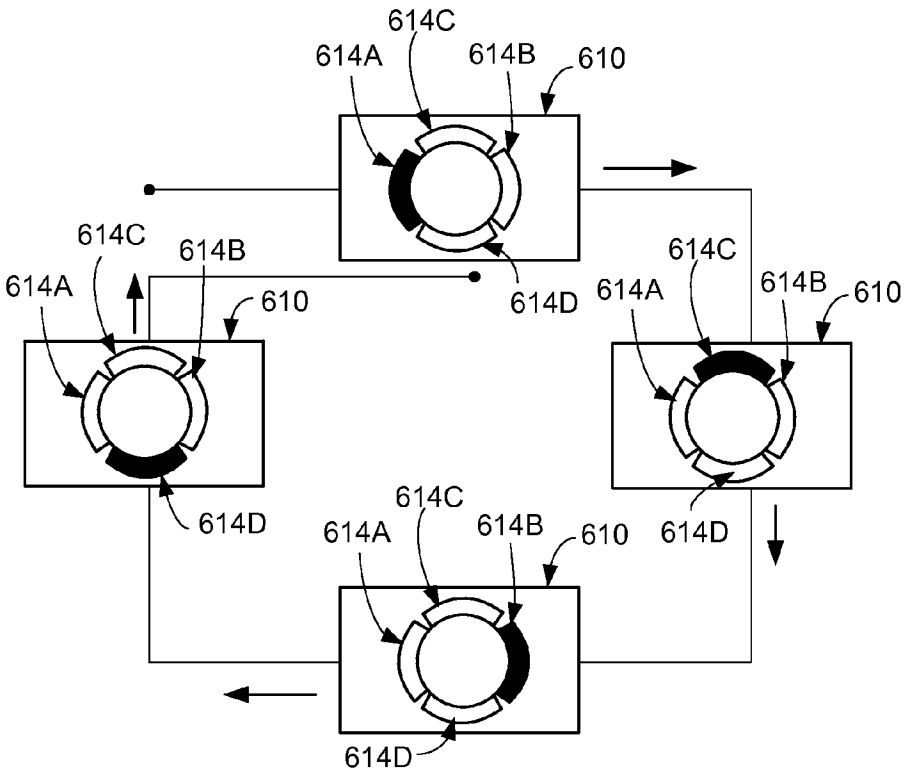
FIG. 10 is a schematic front view illustrating operation of the head of FIG. 8 along a third application path, according to one embodiment.
Figure 9:
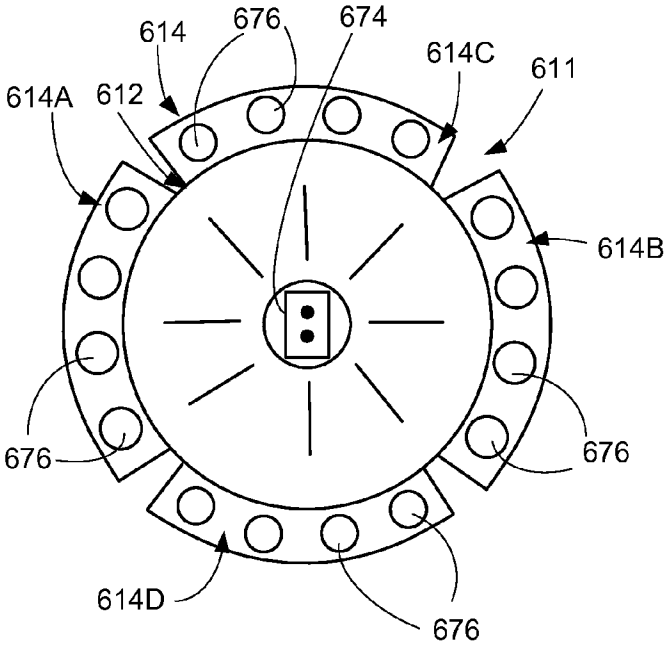
FIG. 9 is a schematic front view illustrating a head of an apparatus for applying and curing a light-curable material on a work surface, according to yet another embodiment.

Referring to FIGS. 9 and 10, the operation of a handling device 610 according to one embodiment is shown. The handling device 610 includes a head 611 with a nozzle portion 612 and a light portion 614. The light portion 614 has four banks 614A, 614B, 614C, 614D of light sources 676 on respective four sides of the head. The banks 614A, 614B, 614C, 614D of light sources 676 are positioned about and radially outwardly spaced apart from a nozzle 674.

Each bank 614A, 614B, 614C, 614D of light sources 676 is positioned on one of a leading edge, trailing edge, and lateral edge of the head 611 depending on the direction of movement of the handling device 610. For example, when the handling device 610 is moving along the application pattern in the direction extending left-to-right across the page, the bank 614A of light sources is a trailing bank and thus is activated, the bank 614B of light sources is a leading bank and thus is not activated, and the banks 614C, 614D of light sources are lateral banks and thus is not activated. However, when the direction of movement of the handling device 610 changes to move along the application pattern in the direction extending top-to-bottom across the page, the bank 614A of light sources becomes a lateral bank and is deactivated, the bank 614B of light sources becomes a lateral bank and remains deactivated, the bank 614C of light sources becomes a trailing bank and is activated, and the bank 614D of light sources becomes a leading bank and remains deactivated. Then, when the direction of movement of the handling device 610 changes to a direction extending right-to-left across the page, the bank 614A of light sources becomes a leading bank and remains deactivated, the bank 614B of light sources becomes a trailing bank and is activated, the bank 614C of light sources again becomes a lateral bank and is deactivated, and the bank 614D of light sources again becomes a lateral bank and remains deactivated. Finally, when the direction of movement of the handling device 610 changes to a direction extending bottom-to-top across the page, the bank 614A of light sources becomes a lateral bank and remains deactivated, the bank 614B of light sources becomes a lateral bank and is deactivated, the bank 614C of light sources becomes a leading bank and remains deactivated, and the bank 614D of light sources becomes a trailing bank and is activated.

Figure 12:
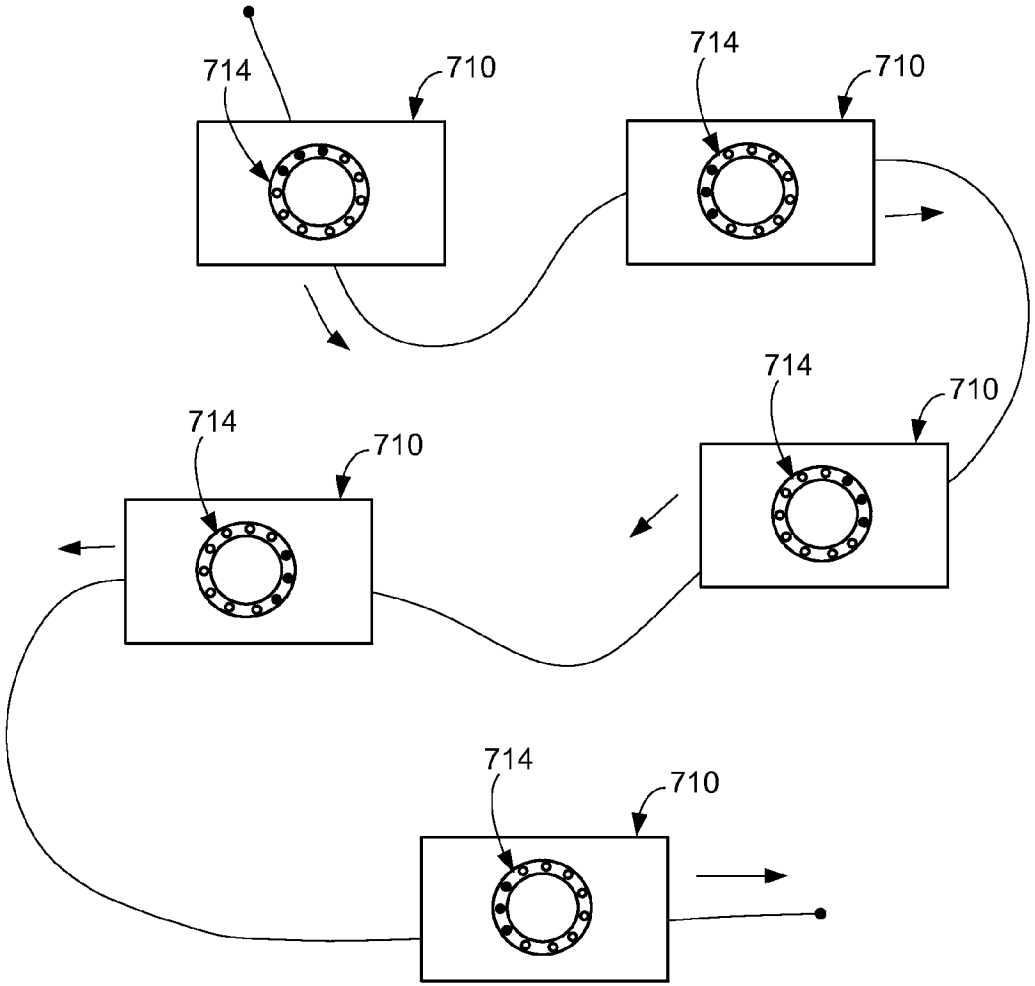
FIG. 12 is a schematic front view illustrating operation of the head of FIG. 11 along a fourth application path, according to one embodiment.
Figure 11:
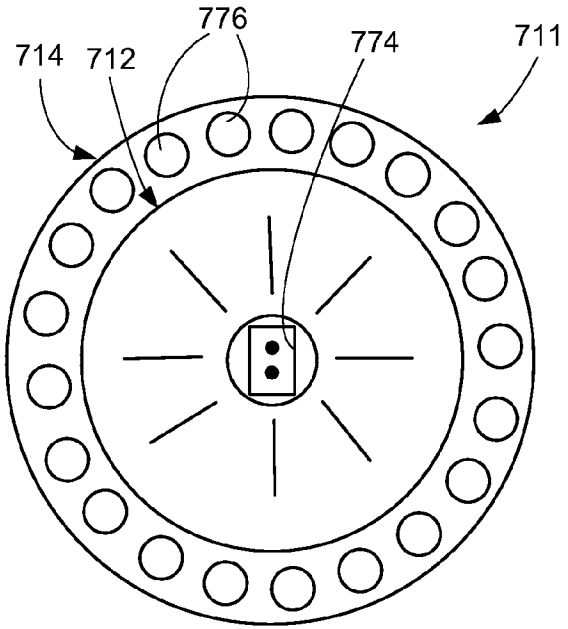
FIG. 11 is a schematic front view illustrating a head of an apparatus for applying and curing a light-curable material on a work surface, according to a further embodiment.

Referring to FIGS. 11 and 12, the operation of a handling device 710 according to one embodiment is shown. The handling device 710 includes a head 711 with a nozzle portion 712 and a light portion 714. The light portion 714 has a plurality of light sources 776 positioned circumferentially in a circle about the head and radially spaced apart from the nozzle 774. The plurality of light sources 776 are not arranged into banks of light sources concurrently activated and deactivated, but rather each light source is individually controlled to be activated or deactivated alone or along with one or more other adjacent light sources depending on the direction of movement of the handling device 710.

Further, each light source 776 is positioned on one of a leading edge, trailing edge, and lateral edge of the head 711 depending on the direction of movement of the handling device 710. For example, when the handling device 710 is moving along the application pattern in only a plurality of light sources 776 occupying a trailing side of the head 711 are activated. When the direction of movement changes, at least one of the activated lights is deactivated and at least one of the deactivated light sources is activated. In some implementations, when the change in direction of movement is gradual (e.g., low rate of change), the switching of activated light sources to deactivated light sources and vice versa is done one light source at a time. In contrast, when the change in direction of movement is rapid (e.g., high rate of change), several light sources can be switched between activated and deactivated at one time. Because the handling device 710 does not switch between activated and deactivated light sources one bank at a time, but rather can provide for switching one light source at a time, more precise control of the direction of the light beam can be achieved and any of various application patterns (e.g., random patterns) can be followed.

Figure 13:
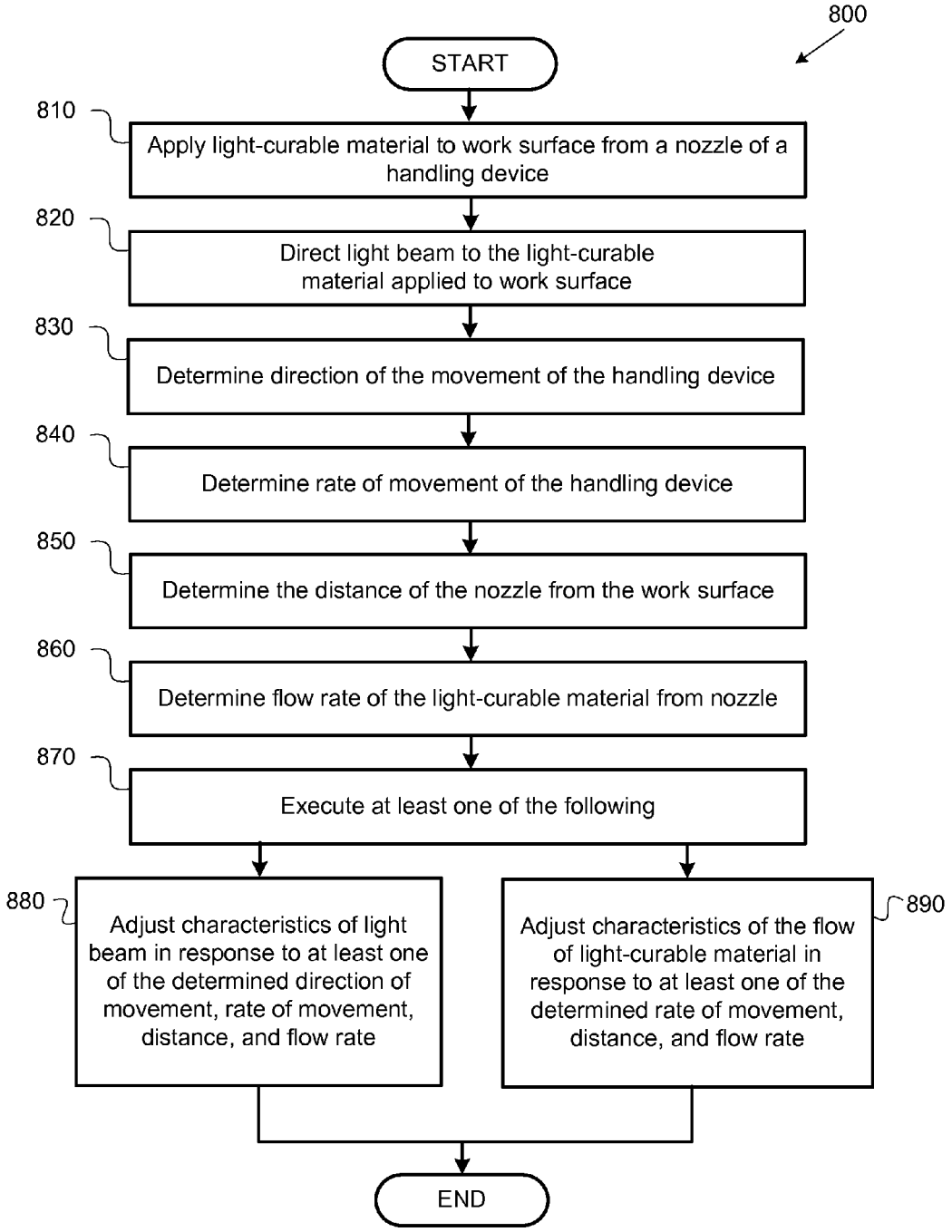
FIG. 13 is a flow diagram illustrating a method of applying and curing a light-curable material on a work surface, according to one embodiment.

Referring to FIG. 13, one embodiment of a method 800 of applying and curing a light-curable material on a work surface is depicted. The method 800 includes applying light-curable material to a work surface from a nozzle of a handling device at 810 as the handling device moves relative to the work surface. Additionally, the method 800 includes directing a light beam to the light-curable material applied to the work surface at 820 as the handling device moves relative to the work surface. The light beam is directed to a trailing edge of the light-curable material as defined by the direction of movement of the handling device. The method 800 further includes determining a direction of movement of the handling device at 830. In certain implementations, the method 800 also includes determining a rate of movement of the handling device at 840. Additionally, in some implementations, the method 800 includes determining a distance of the nozzle from the work surface at 850. The method 800 may further include determining a flow rate of light-curable material from the nozzle at 860.

Step 870 of the method 800 includes executing at least one of steps 880, 890. According to one implementation, the method 800 executes only step 880. In another implementation, the method 800 executes only step 890. According to yet another implementation, the method 800 executes both steps 880, 890.

Step 880 includes adjusting characteristics of the light beam in response to at least one of the determined direction of movement of the handling device, rate of movement of the handling device, distance of the nozzle from the work surface, and flow rate of light-curable material from the nozzle. In some implementations, a control module automatically adjusts the characteristics of the light beam in response to sensed or detected changes in the determined direction of movement of the nozzle, rate of movement of the nozzle, distance of the nozzle from the work surface, and flow rate of light-curable material from the nozzle. The characteristics of the light beam that are adjusted may include direction of the light beam and the intensity of the light beam. The direction of the light beam can be adjusted in response to a change of direction of the movement of the handling device. Also, the direction of movement of the handling device may change in response to a change in the distance of the nozzle from the work surface. As the distance changes, the application area of the flow of light-curable material on the work surface may change, which can necessitate a change in the direction of the light beam to ensure the light beam does not impact the flow before it is applied to the work surface as a layer.

The intensity of the light beam can be adjusted in response to a change in the rate of movement of the handling device. As the rate of movement of the handling device increases, the thickness of the layer of light-curable material may decrease and vice versa. For example, to achieve the same cure state for varying thicknesses of the layer of light-curable material, the intensity of the light beam can be increased if the rate of movement of the handling device is decreased or decreased if the rate of movement of the handling device is increased.

The intensity of the light beam can be adjusted in response to a change in the distance of the nozzle from the work surface. As the distance of the nozzle from the work surface increases, the higher the loss of energy from the light beam and vice versa. For example, to achieve the same cure state of the layer of light-curable material, the intensity of the light beam can be increased for an increase in the distance of the nozzle from the work surface and decreased for a decrease in the distance of the nozzle from the work surface.

The intensity of the light beam can be adjusted in response to a change in the flow rate of light-curable material from the nozzle. Changes in the flow rate of the light-curable material may result in changes in the thickness of the layer of light-curable material. For example, to achieve the same cure state for varying thicknesses of the layer of light-curable material, the intensity of the light beam can be increased for an increased flow rate of light-curable material and decreased for a decreased flow rate of light-curable material.

Step 890 includes adjusting characteristics of the flow of light-curable material in response to at least one of the determined rate of movement of the handling device, distance of the nozzle from the work surface, and flow rate of light-curable material from the nozzle. In some implementations, a control module automatically adjusts the characteristics of the flow of light-curable material in response to sensed or detected changes in the rate of movement of the handling device, distance of the nozzle from the work surface, and flow rate of light-curable material from the nozzle. The characteristics of the flow of light-curable material that are adjusted may include flow rate and flow pattern.

The flow rate can be adjusted in response to a change of the rate of the movement of the handling device. As the rate of movement of the handling device increases, the thickness of the layer of light-curable material may decrease and vice versa. To achieve the same thickness of the layer of light-curable material, the flow rate of the light-curable material can be adjusted. For example, the flow rate can be increased if the rate of movement of the handling device is increased, or the flow rate can be decreased if the rate of movement of the handling device is decreased.

The flow rate or flow pattern of the light-curable material can be adjusted in response to a change in the distance of the nozzle from the work surface. As the distance of the nozzle from the work surface changes, the coverage area of the flow applied to the work surface may change. For example, as the distance increases, the coverage area may also increase and vice versa. To achieve the same thickness of the layer of light-curable material, the flow rate can be changed to compensate for the change in the coverage area of the flow. Alternatively, or additionally, the flow pattern can be adjusted to change the coverage area of the flow in order to achieve the same thickness of the layer of light-curable material.

The flow pattern of the light-curable material can be adjusted in response to a change in the flow rate of light-curable material from the nozzle. Changes in the flow rate of the light-curable material may result in changes in the thickness of the layer of light-curable material. Accordingly, to achieve the same thickness of the layer of light-curable material, the coverage area of the flow can be changed by changing the flow pattern to compensate for changes in the flow rate of the light-curable material.

As will be appreciated by one skilled in the art, aspects of the present disclosure may be embodied as a system, method, and/or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present disclosure may take the form of a computer program product embodied in one or more computer readable medium(s) having program code embodied thereon.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the program code may be stored and/or propagated on in one or more computer readable medium(s).

The computer readable medium may be a tangible computer readable storage medium storing the program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable storage medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store program code for use by and/or in connection with an instruction execution system, apparatus, or device.

The computer readable medium may also be a computer readable signal medium. A computer readable signal medium may include a propagated data signal with program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport program code for use by or in connection with an instruction execution system, apparatus, or device. Program code embodied on a computer readable signal medium may be transmitted using any appropriate medium, including but not limited to wire-line, optical fiber, Radio Frequency (RF), or the like, or any suitable combination of the foregoing.

In one embodiment, the computer readable medium may comprise a combination of one or more computer readable storage mediums and one or more computer readable signal mediums. For example, program code may be both propagated as an electro-magnetic signal through a fiber optic cable for execution by a processor and stored on RAM storage device for execution by the processor.

Program code for carrying out operations for aspects of the present disclosure may be written in any combination of one or more programming languages, including an object oriented programming language such as Java, Smalltalk, C++, PHP or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The computer program product may be shared, simultaneously serving multiple customers in a flexible, automated fashion. The computer program product may be standardized, requiring little customization and scalable, providing capacity on demand in a pay-as-you-go model.

The computer program product may be stored on a shared file system accessible from one or more servers. The computer program product may be executed via transactions that contain data and server processing requests that use Central Processor Unit (CPU) units on the accessed server. CPU units may be units of time such as minutes, seconds, hours on the central processor of the server. Additionally the accessed server may make requests of other servers that require CPU units. CPU units are an example that represents but one measurement of use. Other measurements of use include but are not limited to network bandwidth, memory usage, storage usage, packet transfers, complete transactions, etc.

Aspects of the embodiments may be described above with reference to schematic flowchart diagrams and/or schematic block diagrams of methods, apparatuses, systems, and computer program products according to embodiments of the present disclosure. It will be understood that each block of the schematic flowchart diagrams and/or schematic block diagrams, and combinations of blocks in the schematic flowchart diagrams and/or schematic block diagrams, can be implemented by program code. The program code may be provided to a processor of a general purpose computer, special purpose computer, sequencer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

The program code may also be loaded onto a computer, other programmable data processing apparatus, or other devices to cause a series of operational steps to be performed on the computer, other programmable apparatus or other devices to produce a computer implemented process such that the program code which executed on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and computer program products according to various embodiments of the present disclosure. In this regard, each block in the schematic flowchart diagrams and/or schematic block diagrams may represent a module, segment, or portion of code, which comprises one or more executable instructions of the program code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An apparatus for applying and curing a light-curable material on a work surface, the apparatus comprising:

a nozzle from which the light-curable material is applied to the work surface to form a layer of light-curable material on the work surface, the layer of light-curable material having a leading edge and a trailing edge defined according to a direction of movement of the nozzle relative to the work surface;

a light source comprising a plurality of lights fixed relative to the nozzle, the light source operable to direct a light beam to the trailing edge of the layer of light-curable material;

a direction determination device configured to determine the direction of movement of the nozzle relative to the work surface; and a control module operatively coupled to the light source, the control module configured to control operation of the plurality of lights in response to the direction of movement of the nozzle relative to the work surface determined by the direction determination device, wherein a first plurality of adjacent lights are activated at the trailing edge of the direction of movement and a second plurality of adjacent lights are inactive at the leading edge, and wherein a straight line tangent to the direction of movement intersects the first plurality of adjacent lights.

2. The apparatus of claim 1, wherein the straight line tangent to the direction of movement intersects the second plurality of adjacent lights.

3. The apparatus of claim 2, wherein the light source comprises at least a first light and a second light, the control module activating the first light and deactivating the second light in response to the direction of movement of the nozzle relative to the work surface determined by the direction determination device being a first direction, and deactivating the first light and activating the second light in response to the direction of movement of the nozzle relative to the work surface determined by the direction determination device being a second direction different than the first direction.

4. The apparatus of claim 3, wherein the first light is adjacent a first side of the nozzle and second light is adjacent a second side of the nozzle, the first side being opposite the second side and the first direction being opposite the second direction.

5. The apparatus of claim 2, wherein the light source comprises a first bank of lights comprising a plurality of lights and a second bank of lights comprising a plurality of lights, the control module activating the first bank of lights and deactivating the second bank of lights in response to the direction of movement of the nozzle relative to the work surface determined by the direction determination device being a first direction, and deactivating the first bank of lights and activating the second bank of lights in response to the direction of movement of the nozzle relative to the work surface determined by the direction determination device being a second direction different than the first direction, wherein the first direction bisects the first bank of lights.

6. The apparatus of claim 2, wherein the direction determination device comprises an accelerometer fixed relative to the nozzle, wherein the straight line tangent to the direction of movement bisects the first plurality of adjacent lights.

7. The apparatus of claim 2, further comprising a robotic arm, the nozzle and light source being coupled to the robotic arm, and wherein the direction determination device comprises a controller of the robotic arm.

8. The apparatus of claim 2, wherein:

the direction determination device is operable to determine a rate of movement of the nozzle relative to the work surface; and the control module adjusts an intensity of the light beam in response to the rate of movement determined by the direction determination device.

9. The apparatus of claim 2, further comprising a flow regulation device operable to adjust a flow rate of the light-curable material from the nozzle, and wherein:

the direction determination device is operable to determine a rate of movement of the nozzle relative to the work surface; and the control module adjusts a flow rate of the light-curable material from the nozzle in response to the rate of movement determined by the direction determination device.

10. The apparatus of claim 2, further comprising a distance determination device operable to determine a distance between the nozzle and the work surface, wherein the control module adjusts the light beam in response to the distance between the nozzle and the work surface determined by the distance determination device.

11. The apparatus of claim 2, further comprising:

a distance determination device operable to determine a distance between the nozzle and the work surface; and a flow regulation device operable to adjust at least one characteristic of the flow of the light-curable material from the nozzle;

wherein the control module adjusts the at least one characteristic of the flow of the light-curable material from the nozzle in response to the distance between the nozzle and the work surface determined by the distance determination device.

12. The apparatus of claim 1, further comprising a lens coupled to the light source, the lens being operable to adjust a direction of the light beam from the light source.

13. The apparatus of claim 1, wherein the light source comprises a plurality of lights arranged in a circular pattern about the nozzle.

14. The apparatus of claim 1, wherein:

the light-curable material flows through the nozzle in an application direction; and the light source is offset from the nozzle in the application direction.

15. The apparatus of claim 1, further comprising a light housing comprising a recessed surface, wherein the light source is mounted on the recessed surface.

* * * * *